US006131886A

United States Patent [19]

Venegas, Jr.

[11] Patent Number: 6,131,886

[45] Date of Patent: Oct. 17, 2000

[54] GUARD RAIL WITH PERSONNEL BARRIER

[76] Inventor: Frank Venegas, Jr., 5682 Lake Ridge Dr., Brighton, Mich. 48116-7760

[21] Appl. No.: 09/224,981

[22] Filed: Jan. 4, 1999

Related U.S. Application Data

[63] Continuation of application No. 08/850,845, May 2, 1997, abandoned.

[51] Int. Cl.[7] ..... E04H 17/14

[52] U.S. Cl. ..... 256/59; 256/13.1; 256/19; 256/66; 256/DIG. 2; 403/265

[58] Field of Search ..... 256/1, 19, 59, 256/65, 66, DIG. 1, 13.1; 403/265, 252, 258, 264, 247; 52/155

[56] References Cited

U.S. PATENT DOCUMENTS 5,261,647 11/1993 Venegas, Jr. et al. .

FOREIGN PATENT DOCUMENTS 974055 11/1964 United Kingdom ..... 256/59

2063956 6/1981 United Kingdom ..... 256/59

WO94/27007 11/1994 United Kingdom ..... 256/59

*Primary Examiner*—Daniel P. Stodola

*Assistant Examiner*—Bruce A. Lev

*Attorney, Agent, or Firm*—Gifford, Krass, Groh, Sprinkle, Anderson & Citkowski, PC

[57] ABSTRACT

A personnel guard barrier is combined with a guard rail for protecting machinery and directing traffic. The personal guard barrier is preferably formed of at least one modular unit extending two feet in length. This modular unit includes a vertical stanchion anchored to a guard rail at one end of the vertical stanchion. Polymerized sheathing extends and surrounds this vertical stanchion and has an interior diameter equal to or greater than the outer diameter of the vertical stanchion. The guard rail provided to be used in combination with the personnel guard barrier includes a base and vertical support stanchion preferably fixed to the base. Polymerized sheathing extends the length of the vertical stanchion and also has an interior diameter equal to or greater than the outer diameter of the vertical support stanchion.

4 Claims, 2 Drawing Sheets

GUARD RAIL WITH PERSONNEL BARRIER

RELATED APPLICATION

This application is a continuation of U.S. patent application Ser. No. 08/850,845 filed May 2, 1997 entitled "Guard Rail with Personal Barrier."

BACKGROUND OF THE INVENTION

I. Field of the Invention

The present invention is directed to a personnel barrier for use in conjunction with a guard rail assembly. More particularly, this invention relates to a unique rigid guard rail assembly which can be quickly installed, dismantled, moved and reassembled, in factories, parking lots, stadiums, stairways, porches, balconies and the like. The guard rail with personal barrier protects machinery and people simultaneously.

II. Description of the Related Art

Steel guard rails are commonly used in factories and warehouses to direct forklift traffic and to protect machinery from being hit by forklifts or other potentially damaging objects present in factories and warehouses. While steel guard rails are quite strong, they also generally are quite rigid and, therefore, do not possess high energy absorbing capabilities. Another disadvantage of steel guard rails is that they fail to provide additional protection to people moving about the plant. A still further disadvantage of steel guard rails is that they require maintenance because they rust.

An alternative to steel guard rails are plastic guard rails which, as compared with steel guard rails, can be energy absorbing, are low maintenance, and also have the advantage of being easily colored coated. Unlike steel guard rails, however, plastic guard rails do not provide the same strength that is desirable in the workplace. Like steel guard rails, however, plastic guard rails also do not accommodate a guard system for people working within the plant area. As such, it would be highly desirable to have available guard rails that combine the desirable characteristics of plastic and steel and provide an assembly that guards not only the machinery within the plant but the people working within the plant's structure.

A disadvantage of currently available steel, plastic, or steel and plastic guard rail assemblies is that once they are assembled, they essentially become fixtures in that location. Hence, although such guard rail assemblies may exist, they are not easily removed from one location and reassembled in another location.

SUMMARY OF THE INVENTION

The present invention provides a knock-down guard rail assembly which is readily and easily assembled and disassembled. The guard rail assembly includes a steel subframe surrounded by polymerized sheathing. The guard rail assembly also provides a personal guard barrier for protecting persons working within a guarded environment.

More particularly, the present invention provides a personnel guard barrier adapted to be combined with a guard rail for protecting machinery and directing traffic. The personnel guard barrier of the present invention is preferably formed of at least one modular unit extending two feet in length. This modular unit includes a vertical stanchion anchored to a guard rail at one end of the vertical stanchion. Polymerized sheathing extends and surrounds this vertical stanchion and has an interior diameter equal to or greater than the outer diameter of the vertical stanchion.

The personnel guard barrier also includes two spaced apart horizontal rails removably engaged with the vertical stanchion. Each horizontal rail also includes polymerized sheathing surrounding the rails having an interior diameter equal to or greater than the outer diameter of each horizontal rail.

Two more spaced apart vertical rails are provided. Each rail is located on either side of the vertical stanchion and removably engaged with the horizontal rails. These vertical rails are also sheathed in a polymer material wherein each sheath has an interior diameter equal to or greater than the outer diameter of each of the vertical rails. The vertical and horizontal rails are removably connected by slip on structural fittings such as those provided by Hollaender Manufacturing, Cincinnati, Ohio. These slip on structural fittings are preferably formed in a T-shaped or L-shaped configuration.

The guard rail provided to be used in combination with the personnel guard barrier includes a base and vertical support stanchion preferably fixed to the base. Polymerized sheathing extends the length of the vertical stanchion and also has an interior diameter equal to or greater than the outer diameter of the vertical support stanchion. A top horizontal rail formed of a tubular metal post extends above the vertical stanchion. The horizontal rail includes an aperture for accommodating the vertical stanchion within the horizontal rail. This aperture extends through the horizontal rail and accommodates placement of the vertical stanchion of the personnel barrier through the horizontal rail and atop the vertical support stanchion of the guard rail assembly. Like the metal structures described above, the horizontal rail is also provided with a sheath having a diameter equal to or greater than the outer diameter of the horizontal rail. The polymerized sheath is also provided with a through aperture corresponding to the apertures provided in the underlying horizontal metal rail.

Both the guard rail and the personnel guard barrier are formed of completely removable and replaceable parts. The metal stanchions and rails in conjunction with the polymerized sheathing may be broken down at the site and either replaced or reconfigured as needed.

The advantages of the present invention are many. The present invention provides a maintenance free, readily assembled and disassembled guard rail assembly. The addition of the polymerized sheathing to the metal substructure eliminates maintenance such as painting that is required of standard metal structures.

The guard rail assembly of the present invention can be used for many applications and can be made in any color plastic sheathing and slip on structural fittings. This plastic sheathing can also include warning signs or any indicia that may be preferred.

In alternative embodiments, a plurality of stanchions, sheaths, horizontal and vertical rails can be used. These and other objects, advantages and features of this invention will become apparent upon review of the following specification in conjunction with the drawings.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS

Figure 1:
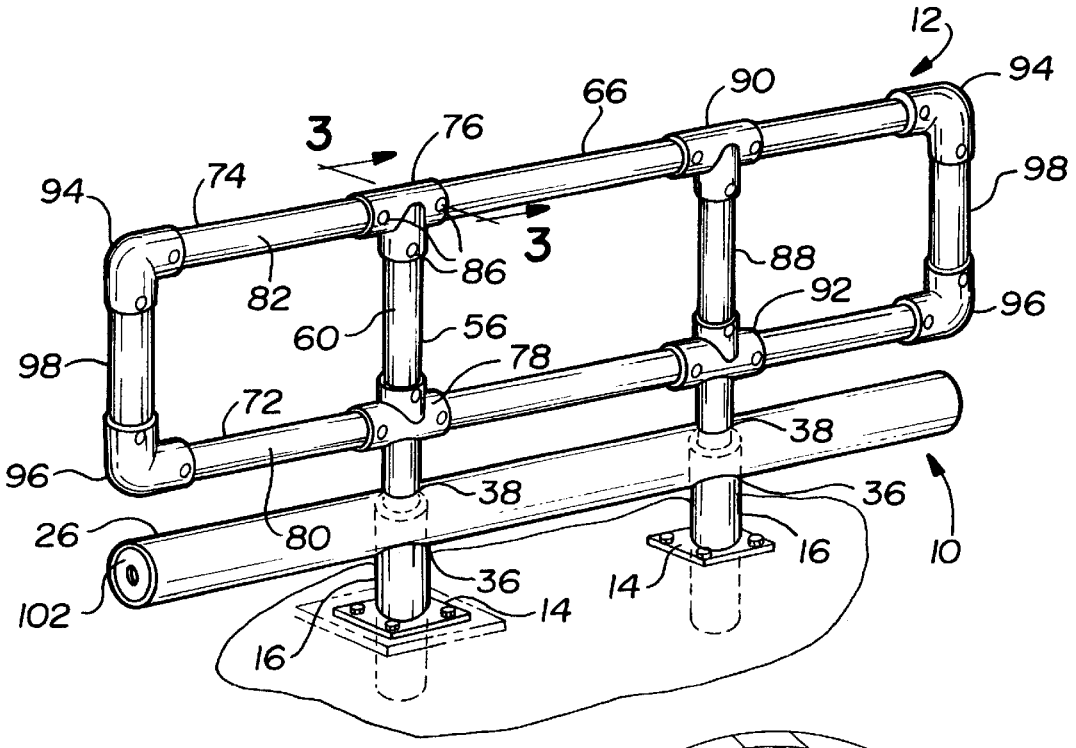
FIG. 1 is an elevational view of a guard rail with personnel barrier in accordance with the present invention.

Referring now to the drawings and the embodiments illustrated therein, FIG. 1 shows a guard rail assembly 10 with a personnel guard barrier 12 adapted to be combined with the guard rail 10. Both the guard rail assembly 10 and personnel guard barrier 12 are preferably a knock-down assembly which is easily assembled and disassembled for removal of the assembly to a separate area, amendment to the profile of the assembly or for replacement of the polymerized sheathing provided therewith.

Specifically, the knock-down guard rail assembly 10 is formed of a base 14 and vertical support stanchion 16 having a vertical tubular metal post 18 affixed to the base 14. (See FIGS. 1 and 4.) Each vertical tubular metal post 18 provided therewith also includes a hollow tubular polymerized sheath 20 extending vertically about the vertical tubular metal post 18. The vertical tubular metal post 18 and hollow tubular polymerized sheath 20 comprise a vertical support stanchion 16.

The hollow tubular polymerized sheath 20 has an interior diameter 22 that is equal to or greater than the exterior diameter of the vertical tubular metal post 18.

Knock-down guard rail assembly 10 is also provided with a top horizontal rail 26 formed of a horizontal tubular metal post 28 and a hollow tubular polymerized sheath 30 extending horizontally about tubular metal post 28. (See FIGS. 1 and 4.) Horizontal tubular polymerized sheath 30 has an interior diameter 32 that is equal to or greater than the exterior diameter 34 of horizontal tubular metal post 28. Horizontal tubular metal post 28 and horizontal tubular polymerized sheath 30 combine to form top horizontal rail 26. Top horizontal rail 26 is also provided with two apertures 36, 38 extending through the rail 26.

Figure 4:
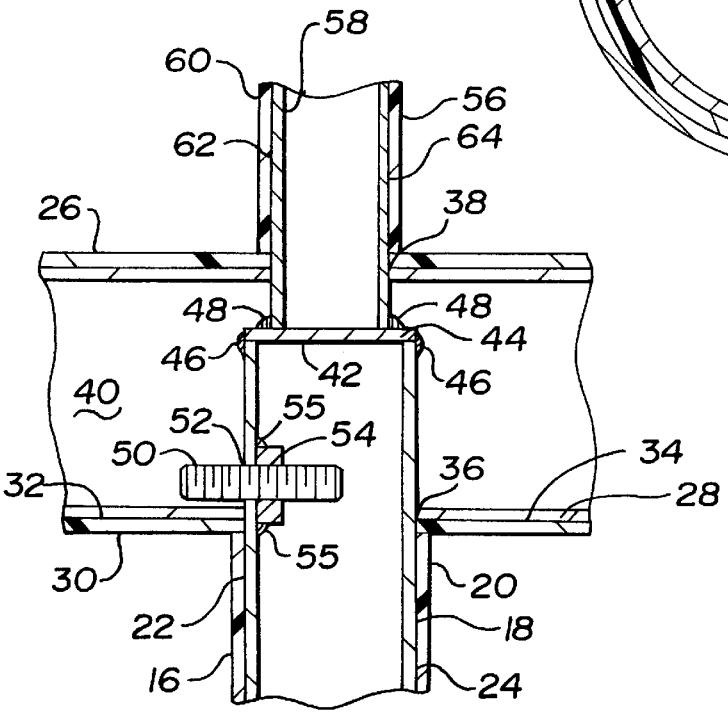
FIG. 4 is a cross-sectional view of the locking mechanism provided with the knock-down guard rail and the support provided for the knock-down personnel guard barrier of the present invention.

Apertures 36, 38 are provided within top horizontal rail 26 for securing and supporting vertical support stanchion 16 of the knock-down guard rail assembly 10 and a vertical support stanchion 56 of the personnel guard barrier 12. With reference to FIG. 4, vertical support stanchion 16 and vertical support stanchion 56 are thereshown intersecting top horizontal rail 26 at corresponding apertures 36, 38. Hollow tubular polymerized sheath 20 extends the length of vertical support stanchion 16 ending at the horizontal tubular polymerized sheath 30 of the top horizontal rail 26. Vertical tubular metal post 18, however, extends into the interior 40 of top horizontal rail 26.

Similarly, vertical support stanchion 56 formed of vertical tubular metal post 58 and hollow tubular polymerized sheathing 60 extends through aperture 38 to the interior 40 of top horizontal rail 26. Like the previously described tubular polymerized sheathing, hollow tubular polymerized sheathing 60 has an interior diameter 62 that is equal to or greater than the exterior diameter 64 of vertical tubular metal post 58. Hollow tubular polymerized sheathing 60 extends the length of vertical support stanchion 56 and abuts horizontal tubular polymerized sheath 30. Vertical tubular metal post 58, however, extends into the interior 40 of top horizontal rail 26 for securement of personal guard barrier 12 to guard rail assembly 10.

A metal plate 42 is preferably fixedly secured to one end 44 of vertical tubular metal post 18 at weld points 46.

In a preferred embodiment of the present invention, vertical tubular metal post 18 has a diameter greater than or equal to vertical tubular metal post 58. As such, vertical tubular metal post 58 may be supported by metal plate 42 extending atop vertical tubular metal post 18. Vertical tubular metal post 58 is fixedly attached to metal plate 42 at weld points 48.

A set screw 50 extends horizontally through an aperture 52 located on one side of vertical tubular metal post 18 within the interior 40 of top horizontal rail 26. Set screw 50 rotates within nut 54 fixedly secured at weld points 55 along the interior of vertical tubular metal post 18. When set screw 50 is fully retracted within vertical tubular metal post 18, hollow tubular polymerized sheath 20 is placed about the post. Correspondingly, horizontal tubular polymerized sheath 30 is placed about horizontal tubular metal post 28 with apertures 36, 38 properly aligned. Top horizontal rail 26 is then placed over vertical tubular metal post 58 previously welded to metal plate 42. Top horizontal rail 26 rests upon hollow tubular polymerized sheath 20 as shown in FIG. 4. Set screw 50 is then extended into interior 40 of top horizontal rail 26 thereby preventing removal of top horizontal rail 26 from guard rail assembly 10.

It is preferred that set screw 50, when fully retracted into vertical tubular metal post 18, abut the interior side of post 18 opposite aperture 52. This prevents set screw 50 from falling down into the bottom of post 18 when said screw 50 is fully retracted. In addition, it is preferred that set screw 50 be extended and retracted by an Allen wrench having a long bit to facilitate rotation of set screw 50 inside vertical tubular metal post 18.

Figure 3:
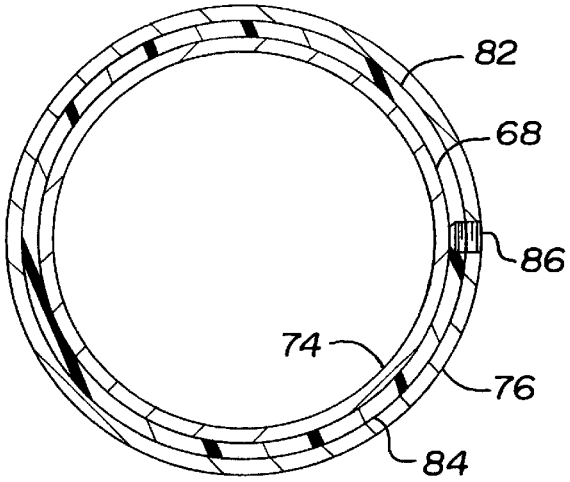
FIG. 3 is a cross-sectional view taken along line 3—3 of FIG. 1.

With reference now to FIGS. 1 and 3, personnel guard barrier 12 is thereshown adapted to be combined with guard rail assembly 10. Personal guard barrier 12 is formed of at least one modular unit 66 preferably extending two feet in length.

In the first preferred embodiment of personnel guard barrier 12, each modular unit 66 is formed by a vertical stanchion 56 anchored to vertical tubular metal post 18 at metal plate 42 of guard rail assembly 10 as shown and described previously in FIG. 4. Vertical stanchion 56 is surrounded by removable and replaceable polymerized sheathing 60. Polymerized sheathing 60 has an interior diameter equal to or greater than the outer diameter of vertical stanchion 56. Each modular unit 66 also includes at least two spaced apart horizontal rails 72, 74 removably engaged to a vertical stanchion 56 preferably by T-shaped Hollaender slip-on structural fittings 76, 78. Horizontal rails 72, 74 are also surrounded by removable and replaceable polymerized sheathing 80, 82 having an interior diameter equal to or greater than the outer diameter of each horizontal rail 72, 74. (FIG. 3.)

Slip-on structural fittings 76, 78, therefore, have an interior diameter 84 that is equal to or greater than the exterior diameter 68 of horizontal polymerized sheathing 80, 82 surrounding horizontal rails 72, 74. Each Hollaender slip-on structural fitting 76, 78 is securely fastened to polymerized sheathing 82 of horizontal rail 74 by set screw 86 as best shown in FIG. 3. Any type of fastening device may be used, however, when using a Hollaender slip on structural fitting, the fitting shall be preferably secured to horizontal rail 74 by knurled cup-point set screws.

In an alternative embodiment, an additional vertical support stanchion formed of a vertical tubular metal post 88 is surrounded by hollow tubular polymerized sheathing 70 identical to vertical stanchion assembly 68 may be provided at a point spaced apart from vertical stanchion 68. Tubular polymerized sheathing 70 has an interior diameter equal to or greater than the exterior diameter of tubular metal post 88. As best shown in FIG. 1, vertical support stanchion 88 is assembled to guard rail assembly 10 by identical means as that displayed in FIG. 4. Vertical support stanchion 88 is also removably engaged to horizontal rail 72, 74 by slip on fittings 90, 92 identical to previously described slip on fittings 76, 78. Additional slip on fittings 94, 96 having an L-shaped configuration are provided for removably engaging horizontal rails 72, 74 to vertical rails 98 as shown in FIG. 1. Vertical rails 98 are spaced apart from vertical support stanchion 68, 88 and complete the modular unit 66 that makes up the personnel guard barrier 12. Vertical rails 98 are surrounded by polymerized sheathing 100 having an interior diameter equal to or greater than the external diameter of rails 98.

Slip-on structural fittings 94, 96 are identically described as slip on structural fittings 76, 78 and are preferably Hollaender slip-on structural fittings having an interior diameter equal to or greater than the exterior diameter of the polymerized sheathing extending the length of vertical rails 98. Slip-on fittings 94, 96 are securely fastened to vertical rails 98 with set screws identical to set screw 86. Preferably, if Hollaender slip-on structural fittings are used, the set screw is a knurled cup-point set screw.

Figure 2:
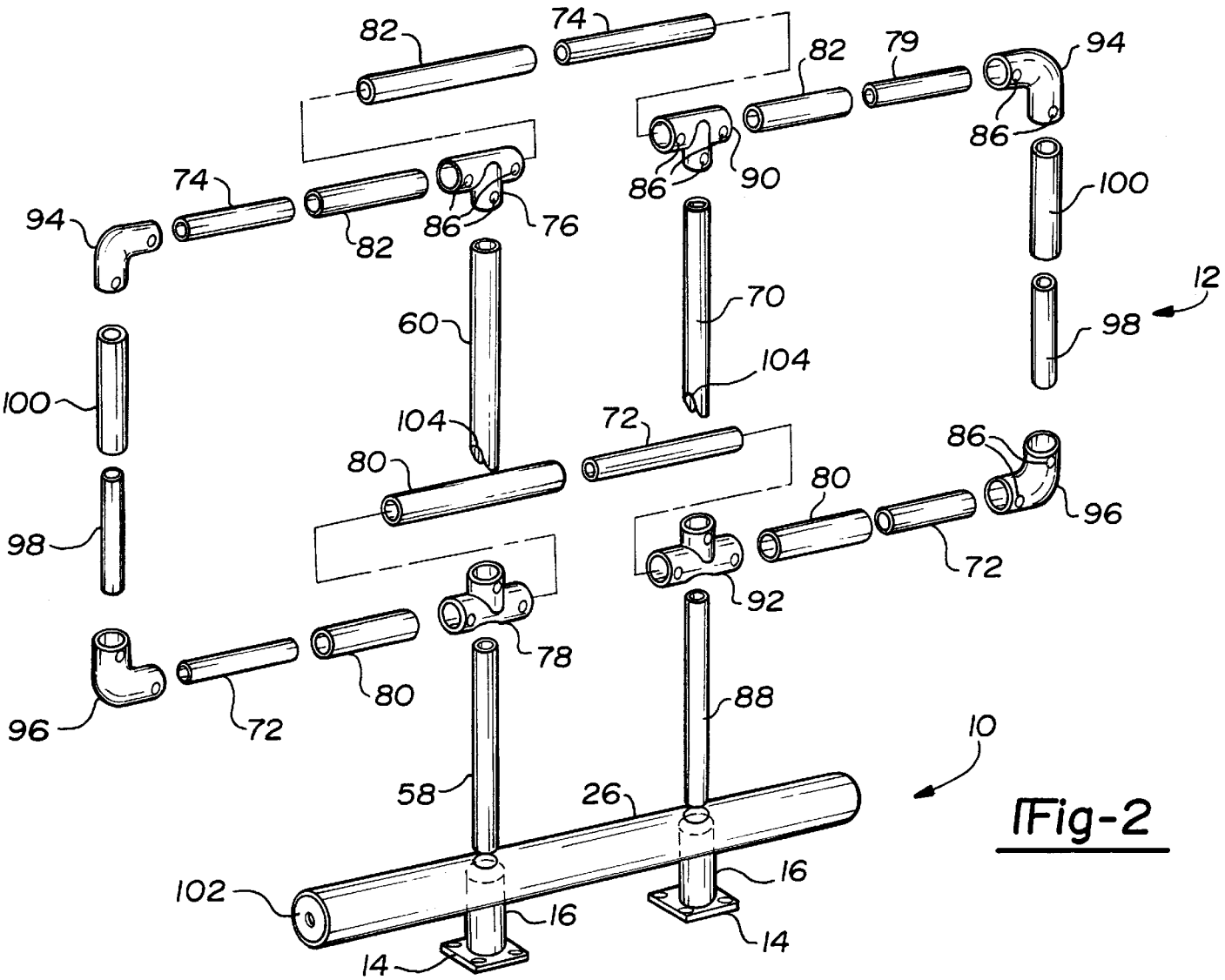
FIG. 2 is an exploded view of the guard rail with personnel barrier in accordance with the present invention.

With reference now to FIG. 2, an exploded view of the present invention is thereshown. Assembly and disassembly of the personnel guard barrier 12 to guard rail assembly 10 is preferably performed as follows.

Vertical stanchion 58, 88 is fixedly secured to interior plates 42 at weld points 48. Polymerized sheathing 60, 70 is then placed over vertical stanchion 58, 88. As noted in FIG. 2, polymerized sheathing 70 has a cut-out profile 104 at one end to properly lay atop horizontal rail 26. Slip-on fitting 78, 92 is then positioned about vertical stanchion 58, 88 respectively. Horizontal rails 72, 74 are covered with polymerized sheathing 80, 82 and slip fit into slip-on fittings 78, 92. Set screws 86 securely fasten horizontal rails 72 and vertical stanchions 58, 88 in place. Slip-on fittings 76, 90 are placed atop vertical stanchions 58, 88 and set screw 86 positions the fittings securely with these vertical stanchions. Additional horizontal rails 74 are sheathed with hollow polymerized sheathing 82 and placed within and between slip-on fittings 76, 90. These horizontal rails are also fixedly secured to the slip-on fittings by set screws 86.

L-shaped slip-on fittings 94, 96 are placed at the open ends of horizontal rails 72, 74 having previously been connected to additional vertical rails with sheathing 98, 100. Set screws 86 secure vertical rails 98 to horizontal rails 72, 74. An end cap 102 may be placed at either end of top horizontal rail 26 to cover the open ends of the rail.

As described above, personnel guard barrier 12 may be provided with a single vertical stanchion 58 or two vertical stanchions 58, 88 with two spaced apart horizontal rails 72, 74, and vertical rails 98 to form one modular unit 66.

Preferred materials for use in the present invention include high density polyethylene for the sheathing and Hollaender slip on structural fittings for assemblage of the personal guard barrier to the guard rail assembly.

The above description is considered that of the preferred embodiment only. Modifications of the invention may occur to those of ordinary skill in the art. Therefore, it is understood that the embodiment shown in the drawings and described above is merely for illustrative purposes and is not intended to limit the scope of the invention.

I claim:

1. A knockdown personnel guard barrier combined with a knockdown guardrail for protecting machinery and directing traffic comprising:

the knockdown guardrail comprising:

a pair of vertical metal guardrail stanchions configured to be secured to a foundation in a spaced apart relationship;

removable and replaceable polymerized sheathing surrounding said vertical metal guardrail stanchions, said sheathing having an interior diameter equal to or greater than the outer diameter of said vertical metal guardrail stanchions;

a top horizontal rail comprising a tubular metal post with a pair of opposed ends and a first pair of apertures defined through a bottom side of said post, said apertures spaced from said ends and having diameters equal to or greater than the outer diameter of said vertical metal guardrail stanchions for locating said tubular metal post atop said vertical metal guardrail stanchions, said tubular metal post further having a second pair of apertures defined through a top side of said post and aligned with said first pair of apertures, said second pair of apertures having diameters smaller than the diameters of said first pair of apertures;

removable and replaceable polymerized sheathing surrounding said tubular metal post;

the knockdown personnel guard barrier being formed of at least one knockdown modular unit, said knockdown modular unit comprising:

a pair of vertical metal barrier stanchions configured for demountable engagement to said knockdown guardrail said barrier stanchions having an outer diameter equal to or less than the diameter of said second pair of apertures, and less than the outer diameter of said vertical metal guardrail stanchions and said tubular metal post, said barrier stanchions passing through said second pair of apertures in said tubular metal post;

removable and replaceable polymerized sheathing surrounding said vertical metal barrier stanchions and having an interior diameter equal to or greater than the outer diameter of said vertical metal barrier stanchions;

at least two spaced apart horizontal metal barrier rails removably engaged with said vertical metal barrier stanchions, said horizontal metal barrier rails having an outer diameter less than the outer diameter of said tubular metal post;

removable and replaceable polymerized sheathing surrounding each of said horizontal metal barrier rails and having an interior diameter equal to or greater than the outer diameter of each of said horizontal metal barrier rails;

at least two spaced apart vertical metal barrier rails located on either side of said vertical metal barrier stanchions and removably engaged with said horizontal metal barrier rails;

removable and replaceable polymerized sheathing surrounding each of said vertical metal barrier rails and having an interior diameter equal to or greater than the outer diameter of each of said vertical metal rails;

means for removably engaging said horizontal metal barrier rails to said vertical metal barrier stanchions; and means for removably engaging said horizontal metal barrier rails to said vertical metal barrier rails.

2. The combination defined in claim 1, wherein said means for removably engaging said horizontal metal barrier rails to said vertical metal barrier stanchion comprises a T-shaped member formed of several legs of polymerized sheathing and having a hollow interior;

wherein each leg of said T-shaped member has an interior profile identical to the exterior profile of said horizontal metal barrier rails and said vertical metal barrier stanchions;

a said interior profile having a diameter equal to or greater than the exterior diameter of said polymerized sheathing surrounding each of said horizontal metal barrier rails and said vertical metal barrier stanchions.

3. The combination as defined in claim 1, wherein said means for removably engaging said horizontal metal barrier rails to said vertical metal barrier rails comprises an L-shaped member formed of several legs of polymerized sheathing and having a hollow interior;

wherein each leg of said L-shaped member has an interior profile identical to the exterior profile of said horizontal metal barrier rails and said vertical metal barrier rails; said interior profile having a diameter equal to or greater than the exterior diameter of said polymerized sheathing surrounding each of said horizontal metal barrier rails and said vertical metal barrier rails.

4. The combination as defined in claim 1, wherein said knockdown modular unit extends two feet in length.

* * * * *